United States Patent [19]

Conforti

[11] 4,302,753

[45] Nov. 24, 1981

[54] MULTI-FUNCTION COMBUSTION DETECTING DEVICE

[75] Inventor: Frederick J. Conforti, Aurora, Ill.

[73] Assignee: Pittway Corporation, Northbrook, Ill.

[21] Appl. No.: 872,444

[22] Filed: Jan. 26, 1978

[51] Int. Cl.³ ..... G08B 17/10; G08B 29/00

[52] U.S. Cl. ..... 340/628; 390/506; 390/533; 390/636

[58] Field of Search ..... 340/629, 628, 630, 506, 340/511, 533, 636

[56] References Cited

U.S. PATENT DOCUMENTS

| | | | |
|---|---|---|---|
| 3,774,186 | 11/1973 | Enemark | 340/630 |
| 3,879,718 | 4/1975 | Roberts | 340/630 |
| 3,899,732 | 8/1975 | Staby | 340/628 |
| 4,020,479 | 4/1977 | Conforti et al. | 340/511 |
| 4,081,795 | 3/1978 | Ogawa | 340/629 |

FOREIGN PATENT DOCUMENTS

| | | |
|---|---|---|
| 479928 | 2/1938 | United Kingdom . |
| 1025589 | 4/1966 | United Kingdom . |

OTHER PUBLICATIONS

Arthur, P. R., "Battery Condition Indicator", *Radio & Electronics Constructor,* vol. 29, No. 3, pp. 174–175, Oct. 1975, London.

*Primary Examiner*—Glen R. Swann, III

*Attorney, Agent, or Firm*—Gary, Juettner & Pyle

[57] ABSTRACT

A battery powered products of combustion detector and warning device, which is interconnectable in a detecting system with other similar devices, is characterized by means for providing separate, distinct and sensibly perceptible signals representative of (a) a standby or quiescent condition of the device, (b) the energy level of the battery decreasing to at least a predetermined level, (c) the sensitivity of the device to the phenomena decreasing to at least a selected level, (d) detection by the device of the occurrence of the phenomena, or (e) detection of the phenomena by another warning device interconnected therewith. In consequence, a user of the warning device is readily and continuously apprised of the operating condition and state of the device.

20 Claims, 2 Drawing Figures

MULTI-FUNCTION COMBUSTION DETECTING DEVICE

BACKGROUND OF THE INVENTION

The present invention relates to warning devices, and in particular to an improved fire detector having means for perceptibly indicating its various states and conditions of operation.

To provide maximum fire protection, it is desirable to monitor the operation of a fire detection device to ensure that the device is adequately powered and is otherwise operating properly. To this end, it is also desirable to provide sensibly discernible indications of the various states and conditions of operation of the detector so that, for example, a user thereof may readily be apprised of the need to take correction action should its operation be amiss.

Where the fire detector is battery powered, a decrease in the energy level of the battery to below a level sufficient to properly operate the detector not only is undesirable, but is intolerable, since such may result in failure of the unit to generate an alarm upon the occurrence of combustion. Merely instructing a user of the device to replace the battery after a predetermined period of time is unsatisfactory, since it is likely that the instructions will either be forgotten or unheeded, ultimately resulting in failure of the detector. Further, due to variations between individual batteries which cause the lengths of their useful lives to vary considerably one from the other, it is possible that a battery may fail before the end of its expected useful life. Consequently, battery powered devices such as fire detectors should be provided with some means for warning users of impending battery failure.

Fair and smoke detectors commonly employ a sensor, such as one or more photocells or ionization chambers, for detecting products of combustion. A disadvantage encountered with such sensors is that certain conditions which occur within the sensor, such as an accumulation of films of dirt and dust, etc., may result in a decrease in the sensitivity of the detector to products of combustion. Should this happen, it is possible that combustion may reach an advanced stage before being detected. Therefore, the detector should also be provided with some means for warning a user of a decrease in the sensitivity thereof and of the need to service the unit to bring the sensitivity back to a nominal level.

In certain uses of fire detectors, such as in multiunit apartment buildings, the detectors often are connected in a system, so that all of the devices generate an alarm upon the detection of products of combustion by any one of the devices. In this manner, should a fire occur anywhere throughout the building, the occupants of all of the units are warned. Since the source of the combustion is not always readily visible or easily discernible, with such systems it is both desirable and advantageous that each individual detector be provided with some means for indicating whether it is generating the alarm in response to detection of combustion by another detector, or if it has itself initiated the alarm.

OBJECTS OF THE INVENTION

A primary object of the present invention is to provide a battery powered warning device for detecting the occurrence of predetermined phenomena, which generates sensibly discernible and distinct indications representative of a quiescent or standby condition of the device, the power level of the battery decreasing to at least a predetermined level, the sensitivity of the device to the phenomena decreasing to at least a selected level, and of the phenomena being detected.

Another object of the present invention is to provide such a warning device which is connectable in a system with other warning devices and which generates sensibly discernible and distinct indications representation of the device itself detecting the phenomena or of one or more of the other devices detecting the phenomena.

SUMMARY OF THE INVENTION

In accordance with the present invention, an improved battery powered warning device comprises means for detecting the occurrence of a predetermined phenomenom and for generating a first sensibly discernible signal in response thereto, means for monitoring the power level of the battery and for generating a second sensibly discernible signal upon the power decreasing to at least a predetermined level, and means for monitoring the sensitivity of the detecting means to the phenomenom and for generating a third sensibly discernible signal upon the sensitivity decreasing to below a selected level. The warning device is connectable with at least one other warning device which generates an interconnect voltage signal upon occurrence of the phenomenom, and receives the interconnect signal and generates a fourth sensibly discernible signal in response thereto. In the absence of any of the first, second, third or fourth sensibly discernible signals, a fifth sensibly discernible signal is generated.

In a preferred embodiment the warning device is a fire detector and the predetermined phenomenom is products of combustion. The means for generating the sensibly discernible signals comprises a lamp and an audible alarm, and the sensibly discernible signals are provided by selective and intermittent actuation of the lamp and audible alarm.

By virtue of the distinct and sensibly discernible indications, a user of the detector is readily apprised of the condition and operating state of the device. For example, the user may determine if the detector is in a standby or quiescent condition, and whether the battery has sufficient power remaining to properly operate the detector. The user also is warned of a decrease in the sensitivity of the detector to products of combustion, and when the unit is connected in a system with other detectors, upon the occurrence of an alarm he may readily determine whether a particular detector is itself responding to products of combustion or whether it is generating the alarm in response to detection of combustion by a remote unit.

The foregoing and other objects, advantages and features of the invention will become apparent from the following detailed description, when taken in conjunction with the accompanying drawings.

IN THE DRAWING

FIG. 1 is a schematic representation of a warning device having indication generating means in accordance with one embodiment of the present invention, and FIG. 2 is a schematic representation of a warning device having indication generating means in accordance with another embodiment of the invention.

DETAILED DESCRIPTION

Figure 1:
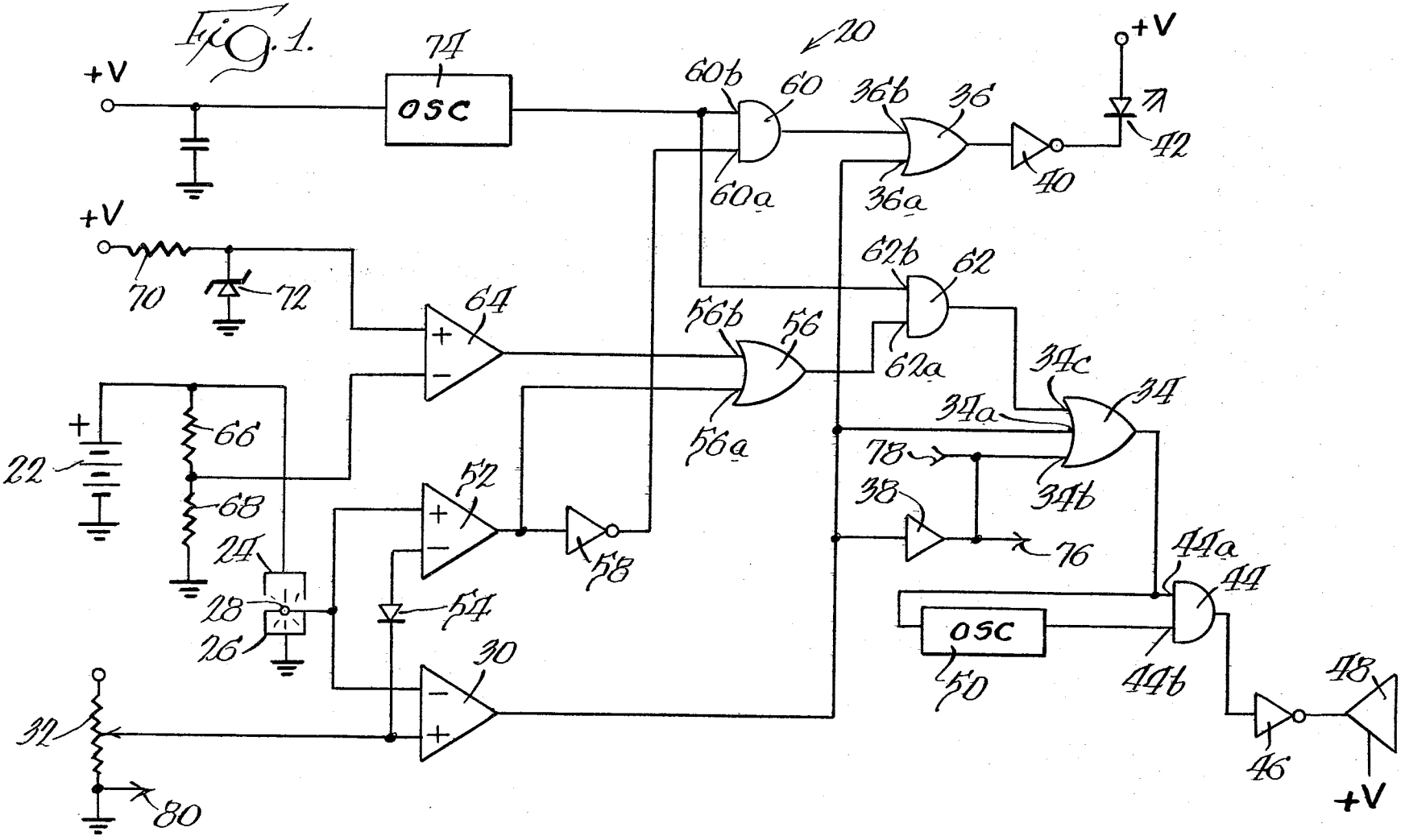

Referring to FIG. 1 of the drawings, there is shown in accordance with one embodiment of the present invention a warning device or fire detector, indicated generally at 20, which generates distinct and sensibly discernible signals representative of its various states and conditions of operation. The detector is battery powered, and includes means for detecting the presence of products of combustion, means for monitoring the sensitivity of the detecting means to products of combustion, means for monitoring the power level of the battery, and means for being interconnected with other devices to form a fire detection system. In accordance with the invention, means are also provided for generating the distinct and sensibly discernible signals representative of (a) the detector being in a quiescent or standby condition, (b) the power level of the battery decreasing to at least a predetermined level, (c) the sensitivity of the detector to products of combustion decreasing to at least a selected level, (d) detection of products of combustion by the detector itself, or (e) detection of products of combustion by another device with which the detector is interconnected.

More particularly, a battery 22 powers the detector, and a pair of ionization chambers 24 and 26 are connected in series across the battery for sensing products of combustion. The chamber 24 is an active ionization chamber which is relatively open to ambient and the chamber 26 is a reference ionization chamber which is relatively closed to ambient, the two chambers together forming a voltage divider so that the voltage at a common center electrode 28 thereof is a function of the relative impedances of the chambers. Atmospheric conditions affect the impedances of the chambers, and for slow changes in atmospheric conditions, as may be caused by changes in temperature, barometric pressure and relative humidity, the reference chamber changes its impedance substantially simultaneously with and in proportion to a change in the impedance of the active chamber, and the voltage at the electrode remains essentially constant. For rapid changes in atmospheric conditions as occur upon combustion, products of combustion enter and concentrate in the relatively open active chamber much more rapidly than in the reference chamber, the impedance of the active chamber increases with respect to that of the reference chamber, and a change occurs in the voltage at the electrode. For the arrangement shown, upon the occurrence of combustion the voltage at the electrode 28 decreases.

To monitor the voltage at the electrode 28 and to generate a signal in response to a predetermined amount of decrease in the voltage which is representative of the occurrence of combustion, an operational amplifier (op amp) 30 is connected at its inverting input with the electrode 28 and at its noninverting input with the slider of a potentiometer 32. The setting of the potentiometer establishes the sensitivity of the detector to products of combustion, and under quiescent conditions and in the absence of products of combustion is adjusted to apply a voltage at the noninverting input to the op amp which is less than the voltage at the inverting input by the predetermined amount. This is the amount of the change in voltage that must occur at the electrode 28 upon the occurrence of combustion for the inverting input to become negative with respect to the noninverting input in order to switch the state of the output signal from the op amp.

For convenience in describing the operation of the detector circuit, reference will be made to signals having a "1" state or level and to signals having a "0" state or level. As is conventional, a 1 level signal may be selected to be of a value which is positive with respect to a 0 level signal, or vice versa, but for the circuit arrangement shown a 1 level signal is considered as being positive with respect to a 0 level signal. It is understood, however, that other arrangements of circuit components and polarities of voltages may be used to provide a detector which embodies the teachings of the present invention and in which 0 level signals are positive with respect to 1 level signals.

Accordingly, in the absence of products of combustion the voltage at the inverting input to the op amp 30 is positive with respect to that at the noninverting input, and a 0 level signal is provided at the output from the op amp. The output is applied directly to a first input **34*a* to an OR gate 34 and to a first input 36*a* to an OR gate 36, and through an amplifier 38 to a second input 34*b* to the OR gate 34. The output from the OR gate 36 is applied through an inverting amplifier 40 to the cathode of a light emitting diode (LED) 42 or first indicating means, the anode of which is connected to battery positive. The output from the OR gate 34 is applied to a first input 44*a* to an AND gate 44, the output from which is connected with an inverting amplifier 46 for controlling the state of a second indicating means, shown as an audible alarm or horn 48. A horn oscillator 50 is connected at an input thereto with the input 44*a* to the AND gate, and is responsive to a 1 signal level thereat to provide a relatively high frequency signal to a second input 44*b*** to the AND gate.

Means for monitoring the sensitivity of the detecting means to products of combustion includes an op amp 52 connected at a noninverting input with the electrode 28 and at an inverting input with the noninverting input to the op amp 30 through a diode 54. The forward voltage drop of the diode provides an offset voltage between the inputs to the op amps 30 and 52, and the arrangement is such that when the sensitivity of the detecting device is properly adjusted, the voltage at the inverting input to the op amp 52 is more positive than the voltage at the noninverting input thereto by a predetermined amount. This provides a 0 signal at the output from the op amp, which is applied directly to a first input **56*a* to an OR gate 56 as a 0 level signal and through an inverting amplifier 58 to a first input 60*a* to an AND gate 60 as a 1 level signal. Should an increase occur in the voltage at the electrode 28, resulting in a decrease in the sensitivity of the detector to products of combustion, upon the voltage increasing by an amount sufficient to bring the noninverting input to the op amp 52 to a level which is positive with respect to that at the inverting input, the output from the op amp changes from a 0 to a 1 state, causing application of a 1 signal at the input 56*a* to the OR gate 56 and a 0 level signal at the input 60*a* to the AND gate 60. The output from the OR gate 56 is applied to one input 62*a* to an AND gate 62, the output from which is applied to a third input 34*c* to the OR gate 34**. This causes generation of an indication representative of low detector sensitivity, as will be described.

To monitor the energy level of the battery 22, an op amp 64 is connected at its inverting input with the juncture between a pair of resistors 66 and 68 connected in series across the battery and at its noninverting input with the juncture between a resistor 70 and a zener diode 72 also connected in series across the battery. The zener diode generates a reference potential with which the voltage of the battery is compared, and whenever the energy level of the battery is above a predetermined level the voltage at the inverting input to the op amp 64 is positive with respect to that at the noninverting input, and the output from the op amp is at a 0 level. Upon a decrease in the battery energy level to at least the predetermined level, the voltage at the inverting input becomes negative with respect to that at the noninverting input, and the output from the op amp switches to a 1 state. The output is applied to a second input 56*b* to the OR gate 56 to cause generation of an indication representative of low battery power, as will be described.

A trouble oscillator 74, which oscillates continuously at a frequency which is relatively low with respect to that of the horn oscillator 50, is connected at its output with a second input 60*b* to the AND gate 60 and with a second input 62*b* to the AND gate 62, and the AND gate 60 is connected at its output with a second input 36*b* to the OR gate 36. For connecting the fire detector 20 in a fire detection system with one or more other detectors, interconnect output and input terminals 76 and 78, respectively, are provided at the output from the amplifier 38, and an interconnect ground reference terminal 80 is connected with the battery. When connected in a system, the interconnect output terminal 76 is connected with the interconnect input terminals 78 of the other detectors, the interconnect input terminal 78 is connected with the interconnect output terminals 76 of the other detectors, and the ground reference terminal 80 is connected with the ground reference terminals of the other detectors.

In the operation of the detector 20, in a standby or quiescent condition of the device the outputs from the op amps 30, 52 and 64 are 0. This provides a 1 level at the input 60*a* to the AND gate 60 so that the low frequency output pulses from the oscillator 74 are passed to the amplifier 40 for intermittently illuminating the LED 42. This also provides 0 level signals at both inputs to the OR gate 56, so that a 0 signal at the output therefrom is applied to the input 62*a* to the AND gate 62 to block passage through the AND gate of pulses from the oscillator 74. Under this condition, all of the inputs to the OR gate 34 are also at a 0 level, so that the input 44*a* to the AND gate 44 is 0 and the horn 48 is off. Consequently, in the standby condition of the detector the first indicating means or LED 42 is intermittently illuminated or pulsed, and the second indicating means or horn 48 is silent or off.

Should the voltage of the battery 22 decrease to below the predetermined level, the output of the op amp 64, which is applied to the input 56*b* to the OR gate 56, changes from 0 to 1. This causes application of a 1 signal to the input 62*a* to the AND gate 62, which enables the AND gate to pass therethrough and to input 34*c* to the OR gate 34 pulses from the oscillator 74. With 0 level signals at the other inputs to the OR gate 34, the pulses pass through the gate and to the input 44*a* to the AND gate 44, and during the occurrence of each pulse the horn oscillator 50 applies relatively high frequency pulses to the input 44*b* to the gate. This results in the AND gate intermittently providing at its output, at the frequency of the pulses from the oscillator 74, a series of high frequency pulses from the horn oscillator 50, whereby the horn 48 is intermittently sounded or pulsed at the frequency of the trouble oscillator 74. Accordingly, upon the energy level of the battery decreasing to below the predetermined level, both the LED and the horn are pulsed.

If changes occur in the ionization chambers 24 and 26 which increase the voltage at the electrode 28 and decrease the sensitivity of the detector to products of combustion, upon the voltage at the electrode increasing by a sufficient amount the voltage at the noninverting input to the op amp 52 becomes positive with respect to that at the inverting input. This results in a change in the output level of the op amp and a 1 signal being applied to the input 56*a* to the OR gate 56 and a 0 signal being applied to the input 60*a* to the AND gate 60. The OR gate then applies a 1 level to the input 62*a* to the AND gate 62, which enables the AND gate to pass therethrough and to the input 34*c* to the OR gate 34 pulses from the trouble oscillator 74. In consequence, and as previously described, the horn 48 is intermittently pulsed or sounded at the operating frequency of the oscillator 74. Simultaneously, the 0 level signal at the input 60*a* to the AND gate 60 blocks passage therethrough of pulses from the trouble oscillator 74, whereby a 1 level signal is provided at the output from the amplifier 40 to extinguish the LED 42. Therefore, upon the sensitivity of the detector decreasing to a predetermined level, a sensibly discernible signal consisting of extinguishing of the LED 42 and pulsing of the horn 48 is provided.

Upon the occurrence of products of combustion is sufficient concentrations to decrease the voltage at the inverting input to the op amp 30 to below that at the noninverting input thereto, a 1 signal is provided at the output from the op amp and is applied to the input 34*a* to the OR gate 34 and the input 36*a* to the OR gate 36. This provides at the output from each of the OR gates a 1 level signal to cause the LED 42 to continuously be illuminated and the horn 48 to continuously be sounded. The 1 signal from the op amp 30 is also applied through the amplifier 38 to the interconnect output terminal 76 for being coupled with remote detectors for causing the same to generate an alarm. Thus, upon the occurrence of combustion, yet another sensibly discernible and distinct signal, comprising a continuous illumination of the LED and a continuous sounding of the horn, is provided.

In the event that a remotely connected detector senses combustion and provides a 1 signal at its interconnect output terminal 76, that signal is applied from the interconnect input terminal 78 to the input 34*b* to the OR gate 34. This generates a 1 level at the output from the OR gate and at the input 44*a* to the AND gate 44 to continuously sound the horn. Simultaneously, the LED 46 is intermittently illuminated, whereby intermittent illumination of the LED and continuous sounding of the horn indicates an alarm generated by a remote detector.

Figure 2:
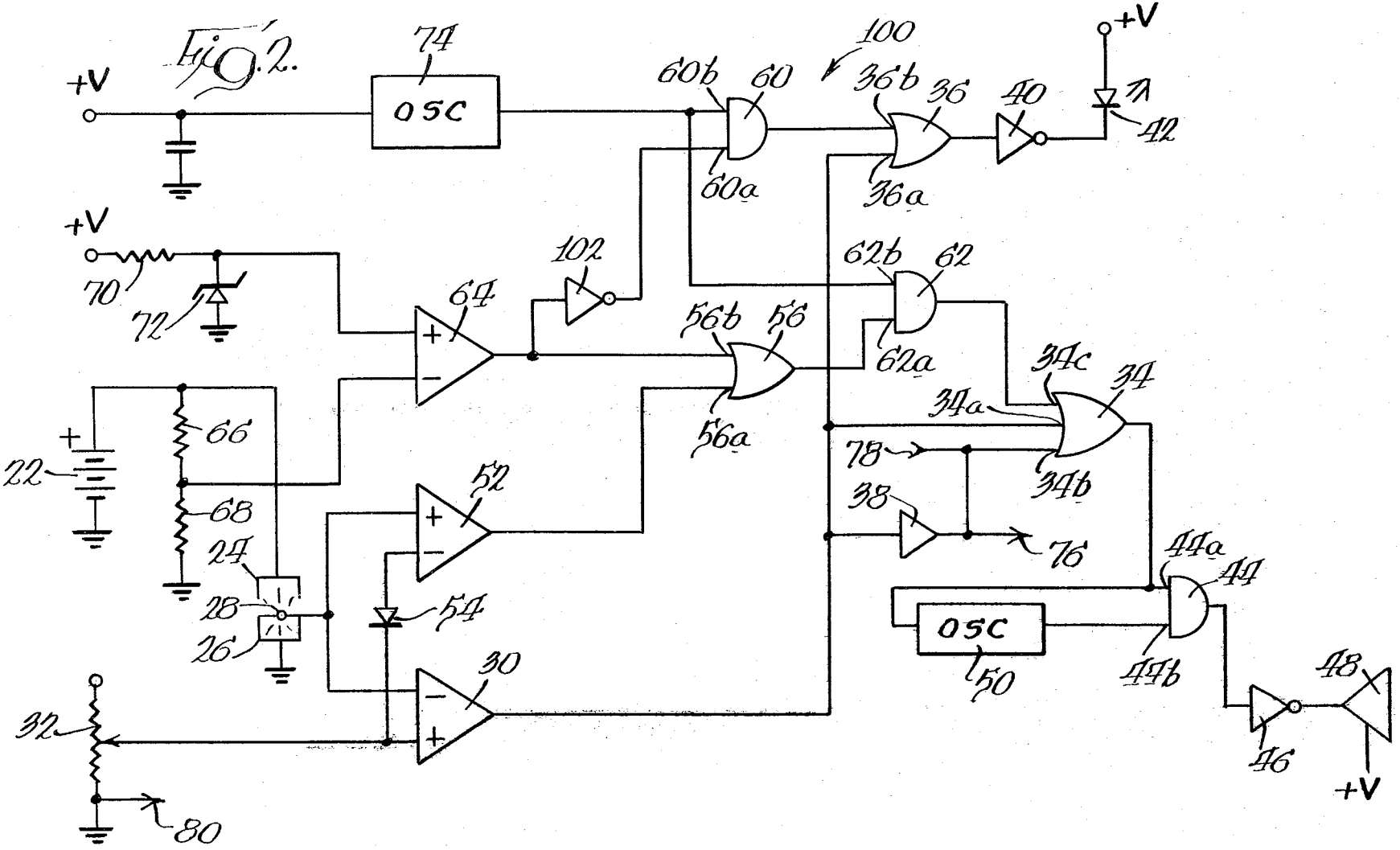

Referring to FIG. 2, there is shown a fire detector or warning device, indicated generally at 100, in accordance with another embodiment of the invention. The detector is somewhat similar to the detector of FIG. 1, and like reference numerals have been used to designate like circuit elements. As compared with the detector of FIG. 1, in response to low detector sensitivity the detector of FIG. 2 provides for intermittent illumination of the LED 42 and intermittent sounding of the horn 48, instead of extinguishing the LED and intermittently sounding the horn, and in response to low battery power it extinguishes the LED and intermittently sounds the horn, instead of intermittently illuminating the LED and intermittently sounding the horn. In all of its other indicating conditions, such as for the standby or quiescent mode, self generated fire alarm and remotely generated fire alarm, the indications provided by the detector of FIG. 2 are identical to those provided by the detector of FIG. 1.

More specifically, to provide its particular low sensitivity and low battery power indications, in the detector of FIG. 2 the output from the op amp 52 is connected only with the input 56*a* to the OR gate 56, and the output from the op amp 64 is connected both with the input 56*b* to the OR gate 56 and with the input 60*a* to the AND gate 60 through an inverting amplifier 102. With this arrangement, upon the voltage of the battery 22 decreasing to below the predetermined level, the output from the op amp 64 changes from a 0 to a 1 level and is applied through the OR gate 56 to the input 62*a* to the AND gate 62 to enable the AND gate to pass therethrough and to the input 34*c* to the OR gate 34 pulses from the oscillator 74. With 0 level signals at the other inputs to the OR gate 34, the pulses pass through the gate and to the input 44*a* to the AND gate 44, thereby providing intermittent sounding of the horn 48 in a manner as described. Simultaneously, the 1 level at the output from the op amp 64 is applied through the inverting amplifier 102 and to the input 60*a* to the AND gate 60 as a 0 level signal, thereby preventing pulses from the oscillator 74 from passing therethrough and providing at the output from the inverting amplifier 40 a continuous 1 level signal to extinguish the LED 42. Thus, in response to low battery power, with the detector of FIG. 2 the LED is extinguished and the horn is intermittently sounded.

Should the sensitivity of the detector decrease with an increasing value of the voltage at the electrode 28, upon the voltage increasing by a sufficient amount the voltage at the noninverting input to the op amp 52 becomes positive with respect to that at the inverting input. This results in a change in the output level of the op amp and a 1 level signal being applied through the OR gate 56 to the input 62*a* to the AND gate 62. In consequence, the AND gate 62 is enabled to pass therethrough pulses from the oscillator 74 whereby, as previously described, the horn 48 is intermittently pulsed or sounded. Simultaneously, the LED 42 continues to be intermittently illuminated, whereby under the condition of low detector sensitivity the LED is intermittently illuminated and the horn is intermittently sounded.

The invention thus provides improved warning devices having sensibly, discernible indicating means for apprising a user of their various conditions and states of operation. In their standby or quiescent state the LED is intermittently pulsed or illuminated and the horn is off, indicating to a user that no action is required. Should battery energy level decrease to a predetermined level, in one of the detectors the LED remains off and the horn is intermittently sounded or pulsed, whereas in the other detector both the LED and the horn are intermittently pulsed, to indicate a need to replace the battery. In the event the sensitivity of the device decreases to a selected level, in one detector both the LED and the horn are intermittently pulsed, and in the other the LED is off and the horn is pushed, thereby apprising a user of a need to service the detector. Should products of combustion be detected both the LED and the horn are continuously on, and if the detector is connected in a fire detection system with one or more other detectors, a pulsing of the LED combined with a continuous sounding of the horn warns the user that a remote detecting unit has detected products of combustion.

While embodiments of the invention have been described in detail, it is understood that various modifications and other embodiments thereof may be devised by one skilled in the art without departing from the spirit and the scope of the invention, as defined by the appended claims.

What is claimed is:

1. An improved warning device, comprising means for detecting the occurrence of predetermined phenomena; means for interconnecting said device with at least one other warning device which generates an interconnect signal when the other warning device detects said predetermined phenomena, and indicator means for generating a first sensibly discernible signal in response to said detecting means detecting said phenomena, a second sensibly discernible signal in response to the occurrence of the interconnect signal, a third sensibly discernible signal whenever neither of said first and second signals is being generated and means for monitoring the sensitivity of said detector means to said phenomena, said indicator means generating a fourth sensibly discernable signal in response to said sensitivity decreasing to at least a selected level, said indicator means generating said third sensibly discernable signal whenever none of said first, second and fourth signals is being generated.

2. An improved warning device as in claim 1, said device being battery powered, and including means for monitoring the voltage level of the battery, said indicator means generating a fourth sensibly discernible signal in response to said battery voltage decreasing to at least a selected level, said indicator means generating said third sensibly discernible signal whenever none of said first, second and fourth signals is being generated.

3. An improved battery powered warning device, comprising means for detecting the occurrence of predetermined phenomena; means for monitoring the voltage level of the battery; means for monitoring the sensitivity of said detecting means to said phenomena, and indicating means for generating a first sensibly discernible signal in response to said detecting means detecting said phenomena, a second sensibly discernible signal in response to said battery voltage decreasing to at least a selected level, a third sensibly discernible signal in response to said sensitivity decreasing to at least a selected level, and a fourth sensibly discernible signal whenever none of said first, second and third signals is being generated.

4. An improved warning device as in claim 3, including means for connecting said device with at least one other warning device which generates an interconnect signal when the other warning device detects said predetermined phenomena, said indicator means generating a fifth sensibly discernible signal in response to the interconnect signal, said indicator means generating said fourth sensibly discernible signal whenever none of said first, second, third and fifth signals is being generated.

5. An improved warning device, comprising means for detecting the occurrence of predetermined phenomena and for generating a first voltage signal in response thereto; means for connecting said warning device with at least one other warning device which generates an interconnect voltage signal when the other warning device detects said predetermined phenomena; first indicator means for generating first and second sensibly discernible signals, and second indicator means for generating third and fourth sensibly discernible signals, said first and second indicator means being responsive to: (a) the absence of said first voltage signal and the interconnect voltage signal to generate said first sensibly discernible signal, (b) the presence of said first voltage signal and the absence of the interconnect signal to generate said second and fourth sensibly discernible signals, and (c) the absence of said first voltage signal and the presence of the interconnect signal to generate said first and fourth sensibly discernible signals.

6. An improved warning device as in claim 5, including means for monitoring the sensitivity of said detecting means to said phenomena and for generating a second voltage signal upon said sensitivity decreasing to at least a selected level, said first and second indicating means being responsive to: (a) the absence of said first and the interconnect voltage signals and the presence of said second voltage signal for generating said first and third sensibly discernible signals, and (b) the absence of said first, second and the interconnect voltage signals for generating said first sensibly discernible signal.

7. An improved warning device as set forth in claim 5, including means for monitoring the sensitivity of said detecting means to said phenomena and for generating a second voltage signal upon said sensitivity decreasing to at least a selected level, said first and second indicating means being response to: (a) the absence of said first and the interconnect voltage signals and the presence of said second voltage signal for generating said third sensibly discernible signal, and (b) the absence of said first, second and the interconnect voltage signals for generating said first sensibly discernible signal.

8. An improved warning device as in claim 6, said device being battery powered, including means for monitoring the voltage level of said battery and for generating a second voltage signal upon the voltage level decreasing to at least a predetermined level, said first and second indicator means being responsive to: (a) the absence of said first and the interconnect voltage signals and the presence of said second voltage signal to generate said third sensibly discernible signal, and (b) the absence of said first, second and the interconnect voltage signals for generating said first sensibly discernible signal.

9. An improved warning device as in claim 5, said device being battery powered, including means for monitoring the voltage level of said battery and for generating a second voltage signal upon the voltage level decreasing to at least a predetermined level, said first and second indicator means being responsive to: (a) the absence of said first and the interconnect voltage signals and the presence of said second voltage signal to generate said first and third sensibly discernible signals, and (b) the absence of said first, second and the interconnect voltage signals for generating said first sensibly discernible signal.

10. An improved warning device as in claim 5, said device being battery powered, including means for monitoring the sensitivity of said detecting means to said phenomena and for generating a second voltage signal upon said sensitivity decreasing to at least a selected level, and means for monitoring the voltage level of said battery and for generating a third voltage signal upon the voltage level decreasing to at least a predetermined level, said first and second indicator means being responsive to: (a) the absence of said first, second and the interconnect voltage signals and the presence of said third voltage signal to generate said third sensibly discernible signal; (b) the absence of said first, third and the interconnect voltage signals and the presence of said second voltage signal for generating said first and third sensibly discernible signals, and (c) the absence of said first, second, third and the interconnect voltage signals for generating said first sensibly discernible signal.

11. An improved warning device as in claim 5, said device being battery powered, including means for monitoring the sensitivity of said detecting means to said phenomena and for generating a second voltage signal upon said sensitivity decreasing to at least a selected level, and means for monitoring the voltage level of said battery and for generating a third voltage signal upon the voltage level decreasing to at least a predetermined level, said first and second indicator means being responsive to: (a) the absence of said first, second and the interconnect voltage signals and the presence of said third voltage signal to generate said first and third sensibly discernible signals; (b) the absence of said first, third and the interconnect voltage signals and the presence of said second voltage signal for generating said third sensibly discernible signal, and (c) the absence of said first, second, third and the interconnect voltage signals for generating said first sensibly discernible signal.

12. An improved warning device as in claim 10, said predetermined phenomena being products of combustion, said first indicator means being a lamp and said first and second sensibly discernible signals being an intermittent illumination and a constant illumination, respectively, of said lamp, said second indicator means being an audible alarm and said third and fourth sensibly discernible signals being an intermittent sounding and a continuous sounding, respectively, of said audible alarm.

13. An improved warning device as in claim 11, said predetermined phenomena being products of combustion, said first indicator means being a lamp and said first and second sensibly discernible signals being an intermittent illumination and a constant illumination, respectively, of said lamp, said second indicator means being an audible alarm and said third and fourth sensibly discernible signals being an intermittent sounding and a continuous sounding, respectively, of said audible alarm.

14. An improved battery powered warning device, comprising means for detecting the occurrence of predetermined phenomena and for generating a first voltage signal in response thereto; means for monitoring the voltage level of the battery and for generating a second voltage signal upon the voltage level decreasing to at least a predetermined level; means for monitoring the sensitivity of said detecting means to said phenomena and for generating a third voltage signal upon said sensitivity decreasing to at least a selected level; first indicator means for generating first and second sensibly discernible signals, and second indicator means for generating third and fourth sensibly discernible signals, said first and second indicator means being responsive to: (a) the absence of said first, second and third voltage signals for generating said first sensibly discernible signal; (b) the presence of said first voltage signal and the absence of said second and third voltage signals for generating said second and fourth sensibly discernible signals; (c) the presence of said second voltage signal and the absence of said first and third voltage signals for generating said third sensibly discernible signal, and (d) the presence of said third voltage signal and the absence of said first and second voltage signals for generating said first and third sensibly discernible signals.

15. An improved battery powered warning device as in claim 14, including means for connecting said warning device with at least one other warning device which generates an interconnect voltage signal when the other warning device detects said predetermined phenomena, said first and second indicating means being responsive to the presence of the interconnect voltage signal and to the absence of said first, second and third voltage signals for generating said first and said fourth sensibly discernible signals, and to the absence of said first, second, third and the interconnect voltage signals for generating said first sensibly discernible signal.

16. An improved battery powered warning device, comprising means for detecting the occurrence of predetermined phenomena and for generating a first voltage signal in response thereto; means for monitoring the voltage level of the battery and for generating a second voltage signal upon the voltage level decreasing to at least a predetermined level; means for monitoring the sensitivity of said detecting means to said phenomena and for generating a third voltage signal upon said sensitivity decreasing to at least a selected level; first indicator means for generating first and second sensibly discernible signals, and second indicator means for generating third and fourth sensibly discernible signals, said first and second indicator means being responsive to: (a) the absence of said first, second and third voltage signals for generating said first sensibly discernible signal; (b) the presence of said first voltage signal and the absence of said second and third voltage signals for generating said second and fourth sensibly discernible signals; (c) the presence of said second voltage signal and the absence of said first and third voltage signals for generating said first and third sensibly discernible signals, and (d) the presence of said third voltage signal and the absence of said first and second voltage signals for generating said third sensibly discernible signal.

17. An improved battery powered warning device, comprising means for detecting the occurrence of a predetermined phenomena and for generating a first voltage signal in response thereto; means for monitoring the voltage level of the battery and for generating a second voltage signal upon the voltage level decreasing to at least a predetermined level; means for monitoring the sensitivity of said detecting means to said phenomena and for generating a third voltage signal upon the sensitivity decreasing to at least a selected level; means for connecting said warning device with at least one other warning device which generates an interconnect voltage signal when the other warning device detects said predetermined phenomena; first indicator means for generating first and second sensibly discernible signals, and second indicator means for generating third and fourth sensibly discernible signals, said first and second indicator means being responsive to: (a) the absence of said first, second, third and the interconnect voltage signals for generating said first sensibly discernible signal; (b) the presence of said first voltage signal and the absence of said second, third and the interconnect voltage signals for generating said second and fourth sensibly discernible signals; (c) the presence of said second voltage signal and the absence of said first, third and the interconnect voltage signals for generating said third sensibly discernible signal; (d) the presence of said third voltage signal and the absence of said first, second and the interconnect voltage signals for generating said first and third sensibly discernible signals, and (e) the presence of the interconnect signal and the absence of said first, second and third voltage signals for generating said first and fourth sensibly discernible signals.

18. An improved battery powered warning device as in claim 17, said predetermined phenomena being products of combustion, said first indicator means being a lamp and said first and second sensibly discernible signals being an intermittent illumination and a constant illumination, respectively, of said lamp, and said second indicator means being an audible alarm and said third and fourth sensibly discernible signals being an intermittent sounding and a continuous sounding, respectively, of said audible alarm.

19. An improved battery powered warning device, comprising means for detecting the occurrence of a predetermined phenomena and for generating a first voltage signal in response thereto; means for monitoring the voltage level of the battery and for generating a second voltage signal upon the voltage level decreasing to at least a predetermined level; means for monitoring the sensitivity of said detecting means to said phenomena and for generating a third voltage signal upon the sensitivity decreasing to at least a selected level; means for connecting said warning device with at least one other warning device which generates an interconnect voltage signal when the other warning device detects said predetermined phenomena and for receiving the interconnect signal; first indicator means for generating first and second sensibly discernible signals, and second indicator means for generating third and fourth sensibly discernible signals, said first and second indicator means being responsive to: (a) the absence of said first, second, third and the interconnect voltage signals for generating said first sensibly discernible signal; (b) the presence of said first voltage signal and the absence of said second, third and the interconnect voltage signals for generating said second and fourth sensibly discernible signals; (c) the presence of said second voltage signal and the absence of said first, third and the interconnect voltage signals for generating said first and third sensibly discernible signals; (d) the presence of said third voltage signal and the absence of said first, second and the interconnect voltage signals for generating said third sensibly discernible signal, and (e) the presence of the interconnect signal and the absence of said first, second and third voltage signals for generating said first and fourth sensibly discernible signals.

20. An improved battery powered warning device as in claim 19, said predetermined phenomena being products of combustion, said first indicator means being a lamp and said first and second snesibly discernible signals being an intermittent illumination and a constant illumination, respectively, of said lamp, and said second indicator means being an audible alarm and said third and fourth sensibly discernible signals being an intermittent sounding and a continuous sounding, respectively, of said audible alarm.

* * * * *